US010626638B2

(12) United States Patent
Ishiguro et al.

(10) Patent No.: US 10,626,638 B2
(45) Date of Patent: Apr. 21, 2020

(54) DOOR LATCH DEVICE

(71) Applicant: GECOM CORPORATION, Greensburg, IN (US)

(72) Inventors: Katsuyuki Ishiguro, Novi, MI (US); Brian Kepler, Novi, MI (US); Aaron Martin, Novi, MI (US); Bryan Farris, Novi, MI (US)

(73) Assignee: GECOM CORPORATION, Greensburg, IN (US)

( * ) Notice: Subject to any disclaimer, the term of this patent is extended or adjusted under 35 U.S.C. 154(b) by 333 days.

(21) Appl. No.: 15/557,060

(22) PCT Filed: Mar. 10, 2015

(86) PCT No.: PCT/JP2015/057070

§ 371 (c)(1),
(2) Date: Sep. 8, 2017

(87) PCT Pub. No.: WO2016/143080

PCT Pub. Date: Sep. 15, 2016

(65) Prior Publication Data

US 2018/0066458 A1 Mar. 8, 2018

(51) Int. Cl.
*E05B 77/26* (2014.01)
*E05B 77/28* (2014.01)
(Continued)

(52) U.S. Cl.
CPC ..... *E05B 77/265* (2013.01); *E05B 77/06* (2013.01); *E05B 77/28* (2013.01); *E05B 77/34* (2013.01);
(Continued)

(58) Field of Classification Search
CPC ..... E05B 81/06; E05B 77/26; E05B 81/16; E05B 77/28; E05B 85/02; E05B 81/64;
(Continued)

(56) References Cited

U.S. PATENT DOCUMENTS 6,102,453 A * 8/2000 Cetnar ..... E05B 77/28 292/199
8,388,030 B2 * 3/2013 Takahashi ..... E05B 81/16 292/201
(Continued)

FOREIGN PATENT DOCUMENTS

JP 2807958 B2 10/1998
JP 2588819 Y2 1/1999
(Continued)

OTHER PUBLICATIONS

International Search Report and Written Opinion of the International Searching Authority, dated May 19, 2015, for corresponding International Application No. PCT/JP2015/057070, 8 pages.

*Primary Examiner* — Mark A Williams
(74) *Attorney, Agent, or Firm* — Klarquist Sparkman, LLP

(57) ABSTRACT

A door latch device having a motor cover for covering a motor and connection parts thereof, wherein the motor cover in a size for covering the motor from a vehicle interior side is formed to a switch member housed in a casing, connection parts of the motor are respectively connected to conductive members of the switch member on a vehicle-exterior-side side face of the motor cover, and the motor 44 and the connection parts thereof are covered with the motor cover.

8 Claims, 15 Drawing Sheets

(51) Int. Cl.

| | |
|---|---|
| ***E05B 77/34*** | (2014.01) |
| ***E05B 85/02*** | (2014.01) |
| ***E05B 81/34*** | (2014.01) |
| ***E05B 81/64*** | (2014.01) |
| ***E05B 77/06*** | (2014.01) |
| ***E05B 81/16*** | (2014.01) |
| ***E05B 81/54*** | (2014.01) |
| ***E05B 81/06*** | (2014.01) |

(52) U.S. Cl.
CPC ..... *E05B 81/06* (2013.01); *E05B 81/16* (2013.01); *E05B 81/34* (2013.01); *E05B 81/54* (2013.01); *E05B 81/64* (2013.01); *E05B 85/02* (2013.01)

(58) Field of Classification Search
CPC .. E05B 81/56; E05B 2015/1664; E05B 81/00; E05B 81/54; Y10T 292/1047; Y10T 292/1082; Y10T 70/5978; Y10S 292/23
See application file for complete search history.

(56) References Cited

U.S. PATENT DOCUMENTS

| | | | | |
|---|---|---|---|---|
| 2006/0087129 | A1* | 4/2006 | Gotou | E05B 77/34 292/216 |
| 2006/0186675 | A1* | 8/2006 | Suzumura | E05B 77/26 292/216 |
| 2008/0203737 | A1* | 8/2008 | Tomaszewski | E05B 77/26 292/216 |
| 2009/0025999 | A1* | 1/2009 | Ishiguro | E05B 77/26 180/287 |
| 2009/0241617 | A1* | 10/2009 | Takahashi | E05B 81/16 70/257 |
| 2016/0362916 | A1* | 12/2016 | Tomaszewski | E05B 85/06 |
| 2017/0314298 | A1* | 11/2017 | Tomaszewski | E05B 77/26 |

FOREIGN PATENT DOCUMENTS

| | | | |
|---|---|---|---|
| JP | 4080737 | B2 | 4/2008 |
| JP | 2009-235845 | A | 10/2009 |

* cited by examiner

DOOR LATCH DEVICE

CROSS-REFERENCE TO RELATED APPLICATION

The present application is the U.S. National Stage of International Application No. PCT/JP2015/057070, filed Mar. 10, 2015.

FIELD

The present invention relates to a vehicle door latch device.

BACKGROUND

Some door latch devices comprise a locking/unlocking motor for control of an operation mechanism shifting a door between a lock state and an unlock state, and a double locking motor for preventing a locking/unlocking lever (locking lever) from shifting to an unlock state due to that a locking knob which is provided in a vehicle interior side for locking/unlocking operation is operated wrongly from a vehicle exterior side, by controlling the locking/unlocking lever of the operation mechanism to be in a double lock state (for example, please refer to Patent Literature 1).

PRIOR ART

Patent Literatures

Patent Literature 1: JP 2009-235845 A

SUMMARY

As described in the above Patent Literature 1, a door latch device comprising two motors that are a locking/unlocking motor and a double locking motor often has an arrangement that the double locking motor is housed below a knob lever connected to a locking knob (a first locking lever in Patent Literature 1), a locking/unlocking lever actuated by the locking/unlocking motor (a second locking lever in Patent Literature 1), a key lever connected to a key cylinder, etc. in a lower portion of a casing.

When the double locking motor is housed in the lower portion of the casing, there are disposed a through hole passed through by a motion transmission member such as a Bowden cable connected to a knob lever, a through hole passed through by a shaft of the key lever, etc. in an upper portion of the casing. Therefore, there are cases that rainwater getting into the casing via the through holes attaches to connection parts between a switch member and the double locking motor housed in the casing, and causes a malfunction of the double locking motor.

In view of the above disadvantages, an object of the present invention is to provide a door latch device having an improved waterproof property for a motor and connection parts thereof.

Means for Solving the Problems

The above problems are solved by the present invention as follows.

A first invention comprises a casing, a motor housed in the casing for controlling an operation mechanism which shifts a door between a lock state and an unlock state, and a switch member housed in the casing and comprising a conductive member electrically conductive to the motor, wherein the switch member has a motor cover in a size for covering the motor from a vehicle interior side, wherein a connection part of the motor is connected to the conductive member on a vehicle-exterior-side side face of the motor cover, and the motor and the connection part are covered with the motor cover from a vehicle interior side, and wherein the motor is housed in the casing below a connector of the switch member connected to an external connector and a motion transmission member connected to an operation lever which is a part of the operation mechanism.

A second invention according to the above first invention, wherein a motor housing part which is open inward of a vehicle is formed on the casing, and an opening of the motor housing part is shielded by the motor cover in a state that the motor is housed in the motor housing part.

A third invention according to the above second invention, wherein a vehicle-interior-side side face of the motor cover is covered with a cover fixed to the casing.

A fourth according to any one of the above first to third inventions, wherein the motor is a double locking motor for controlling a locking/unlocking lever which is a part of the operation mechanism to be in a double lock state, or is a childproof locking motor for shifting a childproof locking mechanism between a childproof lock state and a childproof unlock state.

Advantages of Invention

According to the present invention, a motor cover in a size for covering a motor housed in a casing from a vehicle interior side is formed to a switch member housed in the casing, and connection parts of the motor are connected to a conductive member of the switch member on a vehicle-exterior-side side face of the motor cover. Therefore, the motor and its connection parts with the conductive member are covered with the motor cover, and a waterproof property is improved.

EMBODIMENTS OF THE INVENTION

Figure 1:
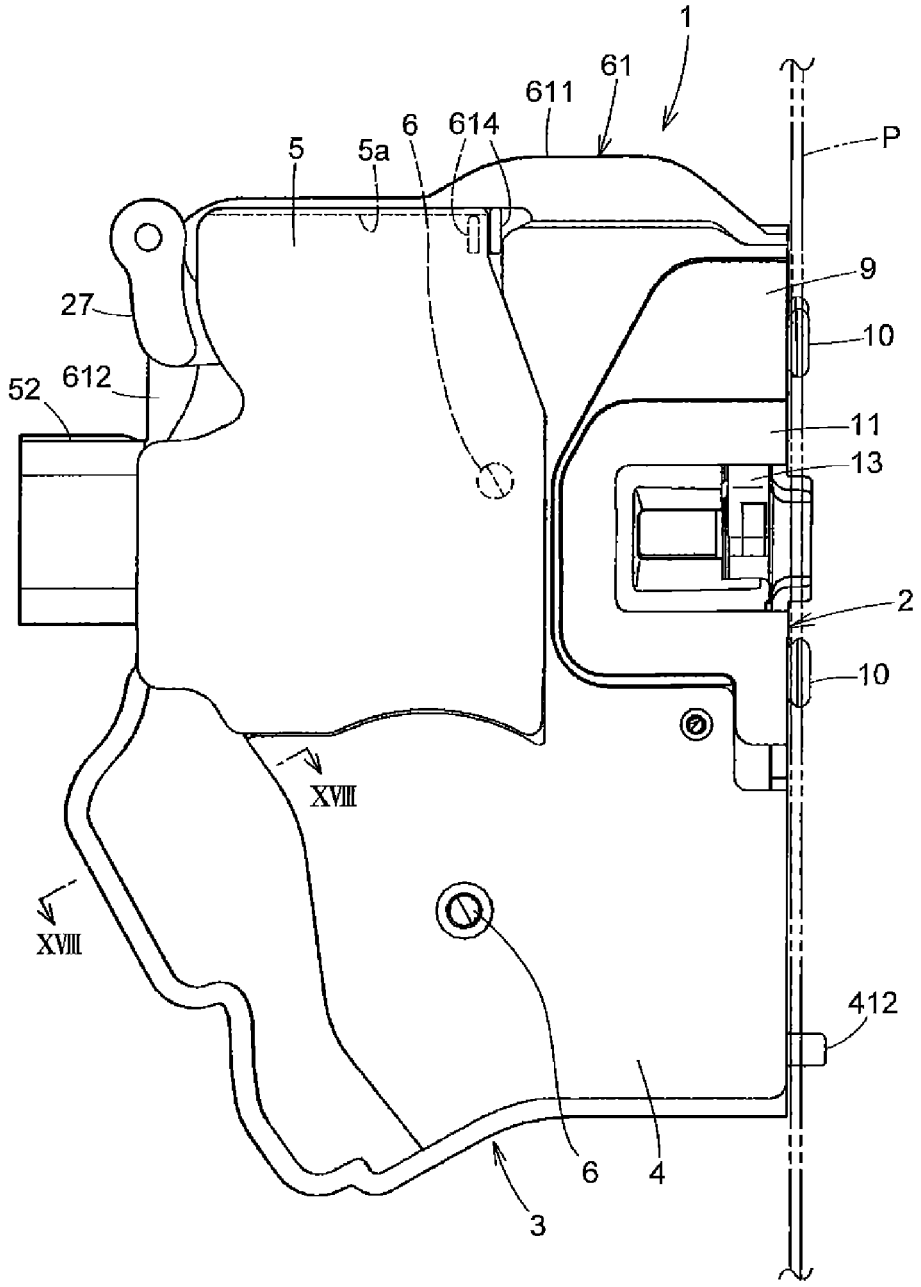
FIG. 1 is a side elevational view showing a door latch device of an embodiment of the present invention, viewed from a vehicle interior side.

An embodiment according to the present invention is described with the drawings as follows.

As shown in FIGS. 1-8, a door latch device 1 is provided in a rear end portion of a rear door of a vehicle (not shown). The door latch device 1 comprises an engagement unit 2 for holding the door at a closed position and an operation unit 3 integrally connected to the engagement unit 2 for operating an engagement mechanism described below of the engagement unit 2. In order to clearly show an internal structure of the actuator unit 3, a cover 4 and an auxiliary cover 5 (see FIG. 6) respectively covering an inward side of the actuator unit 3 are omitted in FIGS. 3, 4, and a casing 7 covering an outward side of the actuator unit 3 is omitted in FIG. 5.

Figure 6:
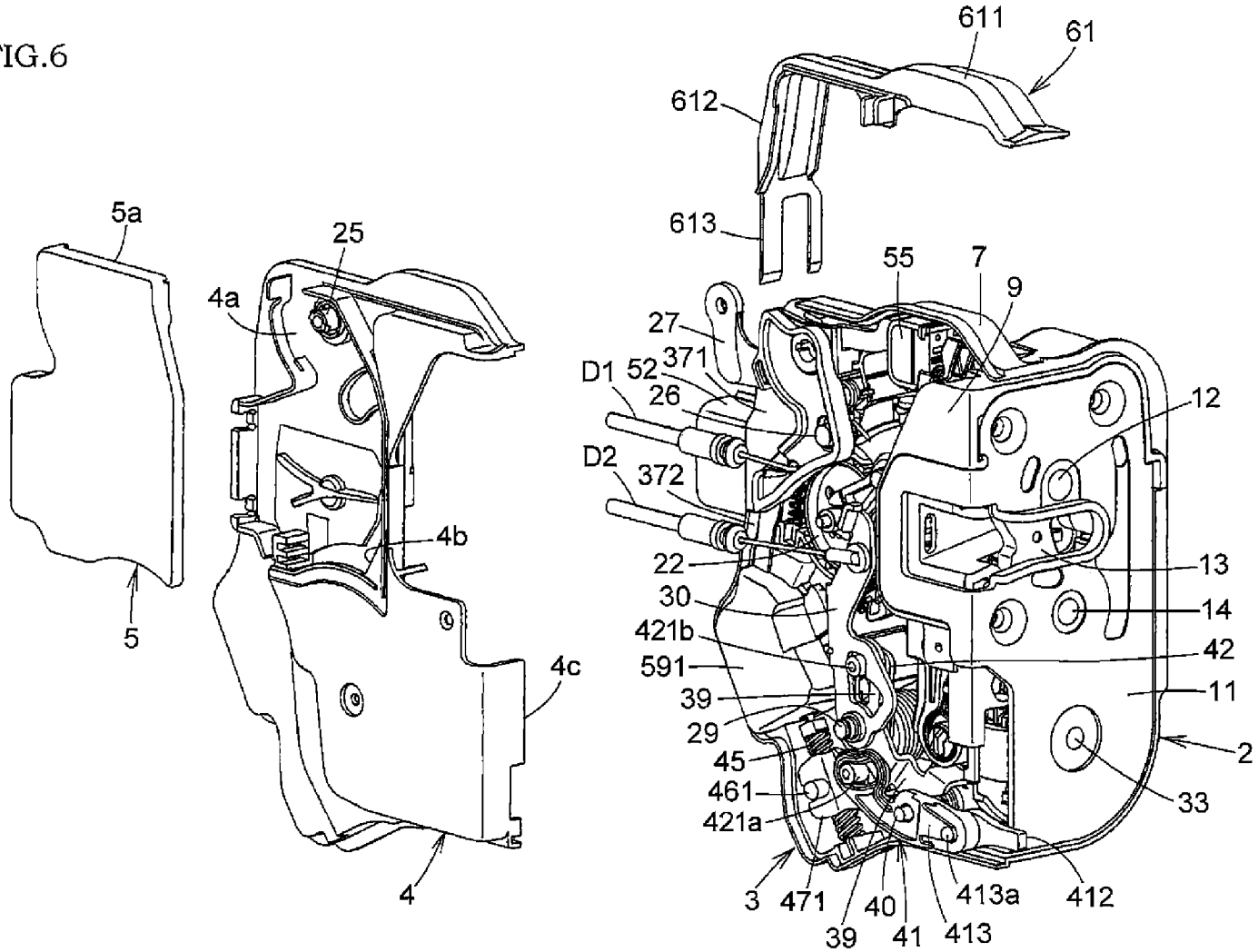
FIG. 6 is a perspective view showing a cover, an auxiliary cover, a top waterproof cover, and the door latch device which is in a state before attaching these covers, viewed from an obliquely rearward direction.
Figure 8:
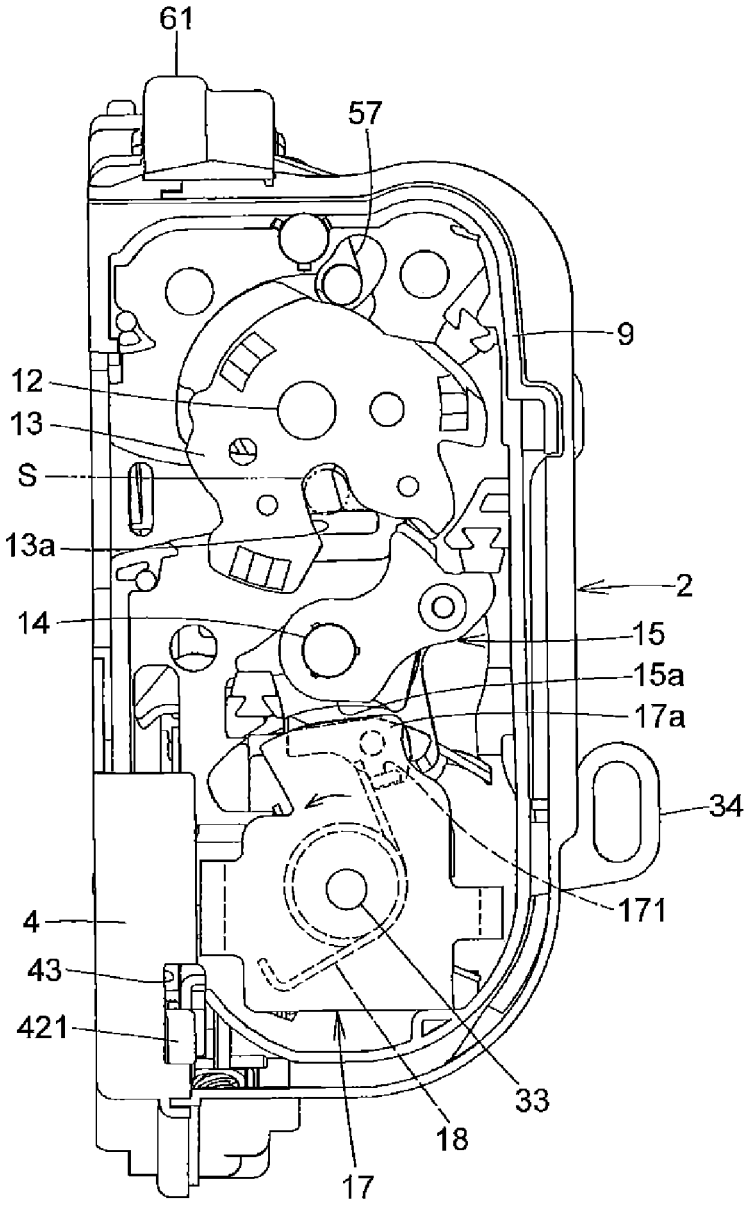
FIG. 8 is a rear elevational view showing the door latch device from which a cover member of an engagement unit is detached.

As shown in FIGS. 6, 8, the engagement unit 2 comprises a box-like synthetic-resin body 9 having an opening on its rear surface;

a metal cover member 11 (not shown in FIG. 8) fixed to the rear surface of the body 9, and fixed to an inner side face of a rear end portion of an inner panel P of the door together with the body 9 with bolts 10 (see FIG. 1);

a latch 13 held in an internal space between the body 9 and the cover member 11 while supported by a latch shaft 12 extending in a longitudinal direction of the vehicle, the latch 13 having an engagement groove 13*a* with which a striker S of a vehicle body can engage;

a ratchet 15 also held in the internal space between the body 9 and the cover member 11 while supported by a ratchet shaft 14 extending in the longitudinal direction of the vehicle, wherein the ratchet 15 prevents the latch 13 from turning in an opening direction (direction for releasing an engagement with the striker S) by engaging with the latch 13;

an opening lever 16 (see FIGS. 3, 5) fixed to the ratchet shaft 14 in a front face side of the body 9 and pivoting with the ratchet 15; and a metal inertia lever 17 held below the ratchet 15 in the internal space between the body 9 and the cover member 11 while pivotally supported by a shaft 33 extending in the longitudinal direction of the vehicle, the shaft 33 also supporting an outside lever 34 described below.

The engagement mechanism is composed by the above latch 13 and ratchet 15.

The inertia lever 17 prevents the door from unexpected opening by keeping the engagement state of the latch 13 and the ratchet 15 even if a crash load affects the door latch device inward by a lateral crash, etc., and acts as follows.

The inertia lever 17 is formed such that its center of gravity is positioned at a center of the shaft 33, and is perpetually biased clockwise in FIG. 8 by a spring 18 of which an end is engaged with a projection 171 formed on a front face of the inertia lever 17. An outer end portion of the opening lever 16 pivoting with the ratchet 15 comes into contact with the projection 171 at a part opposite to the engagement part of the spring 18.

When an inside lever 30 and the outside lever 34 described below are released, the opening lever 16 and the ratchet 15 are turned in a releasing direction by an opening link 28 described below. Then, the door can be opened. At this moment, because the inertia lever 17 is turned counterclockwise against the spring 18 by the opening lever 16 as indicated by an arrow in FIG. 8, a door opening operation is not interfered.

Because the inertia lever 17 is formed such that its center of gravity is positioned at a center of the shaft 33, it does not turn even if a crash load affects the door latch device externally. Therefore, even if the ratchet 15 is about to turn in the releasing direction (counterclockwise in FIG. 8) by an inertia load due to a crash, a lower end 15*a* of the ratchet 15 immediately comes into contact with an outer upper end 17*a* of the inertia lever 17 which is at rest at a fixed position by the spring 18, and thereby blocking the turning in the releasing direction of the ratchet 15. Thus, because there is no risk that the ratchet 15 is released from the latch 13 at a moment of a crash, the engagement state between the latch 13 and the ratchet 15 is kept to prevent the door from unexpected opening at a time of a crash, etc. In order to prevent the inertia lever 17 from turning owing to the ratchet 15, a contact part between the lower end 15*a* of the ratchet 15 and the upper end 17*a* of the inertia lever 17 is preferably set on a vertical line passing the center of the shaft 33.

As shown in FIGS. 3-6, the actuator unit 3 comprises the above described synthetic-resin casing 7 fixed to the body 9 of the engagement unit 2;

a locking/unlocking motor 19 housed in a front upper portion of the casing 7 such that its rotation shaft is tilted in an oblique front lower direction, wherein the motor 19 bidirectionally rotates by operation of a remote control switch, etc. (not shown);

a worm 20 fixed to the rotation shaft of the locking/unlocking motor 19;

a worm wheel 22 engaging with the worm 20 and pivotally supported by a shaft 21 extending in a transverse direction of the vehicle;

a locking/unlocking lever 24 pivotally supported by a shaft 23 extending in the transverse direction of the vehicle in the casing 7 and pivoting between an unlock position in which the door opening operation is possible and a lock position in which this operation is impossible;

a knob lever 27 pivotally supported by a shaft 25 (see FIG. 6) which is formed on an upper portion of the above described cover 4 and is extending in an inward direction, wherein the knob lever 27 is connected to a locking knob (not shown) provided on the inner side of the door for manual operation by a motion transmission member D1 such as a Bowden cable, and wherein a lower portion of the knob lever 27 is connected to a pin 26 which is formed on an upper end portion of the locking/unlocking lever 24 and is extending in an inward direction;

the opening link 28 pivoting between an unlock position and a lock position in conjunction with the locking/unlocking lever 24;

the inside lever 30 of which a lower end portion is pivotally supported by a shaft 29 extending in the transverse direction of the vehicle on the casing 7, and of which an upper end portion is connected to an inside handle (not shown) provided on the inner side of the door for door opening operation by a motion transmission member D2 such as a Bowden cable;

the outside lever 34 pivotally supported by a shaft 33 (see FIG. 8) extending in the longitudinal direction of the vehicle on the body 9, and connected to an outside handle (not shown) provided on the vehicle exterior side of the door by a rod, etc. (not shown);

a childproof locking mechanism 35 shifting between a childproof unlock state in which the door opening operation by the inside handle is transmitted to the opening link 28 and the ratchet 15 of the engagement unit 2 via the inside lever 30 and a childproof lock state in which this transmission is impossible;

a double locking mechanism 36 preventing the unlock state due to a wrong operation of the locking knob in the vehicle interior side; and a switch member 37 electrically conductive to the locking/unlocking motor 19 and a double locking motor 44 described below, etc. respectively.

An operation mechanism of the present invention comprises the locking/unlocking motor 19, the worm wheel 22, the locking/unlocking lever 24, the knob lever 27, the opening link 28, the inside lever 30, the childproof locking mechanism 35, and the double locking mechanism 36 including the double locking motor 44 described below, etc. The knob lever 27 and the inside lever 30 correspond to operation levers of the present invention.

As shown in FIG. 6, a connection region 4*a* for connecting the motion transmission members D1, D2 to the knob lever 27 and the inside lever 30 respectively is formed on the vehicle interior side of the front upper portion of the synthetic-resin cover 4. The knob lever 27 is pivotally supported by the shaft 25 which is formed on the connection region 4*a* and is extending in the inward direction, and its lower portion is connected to an end of the motion transmission member D1 in the connection region 4*a*. An upper end portion of the inside lever 30 projects to the connection region 4*a* through a notch 4*b* formed on the cover 4. The projected end portion is connected to an end of the motion transmission member D2. As shown in FIG. 1, the connection region 4*a* is covered with the above described synthetic-resin auxiliary cover 5 fixed to the cover 4, thereby preventing rainwater from getting into the casing 7 via the connection region 4*a*.

As shown in FIG. 1, the cover 4 is fixed to the casing 7 with upper and lower screws 6, 6 while the vehicle-interior-side side face of the body 9 of the engagement unit 2 is exposed.

Figure 2:
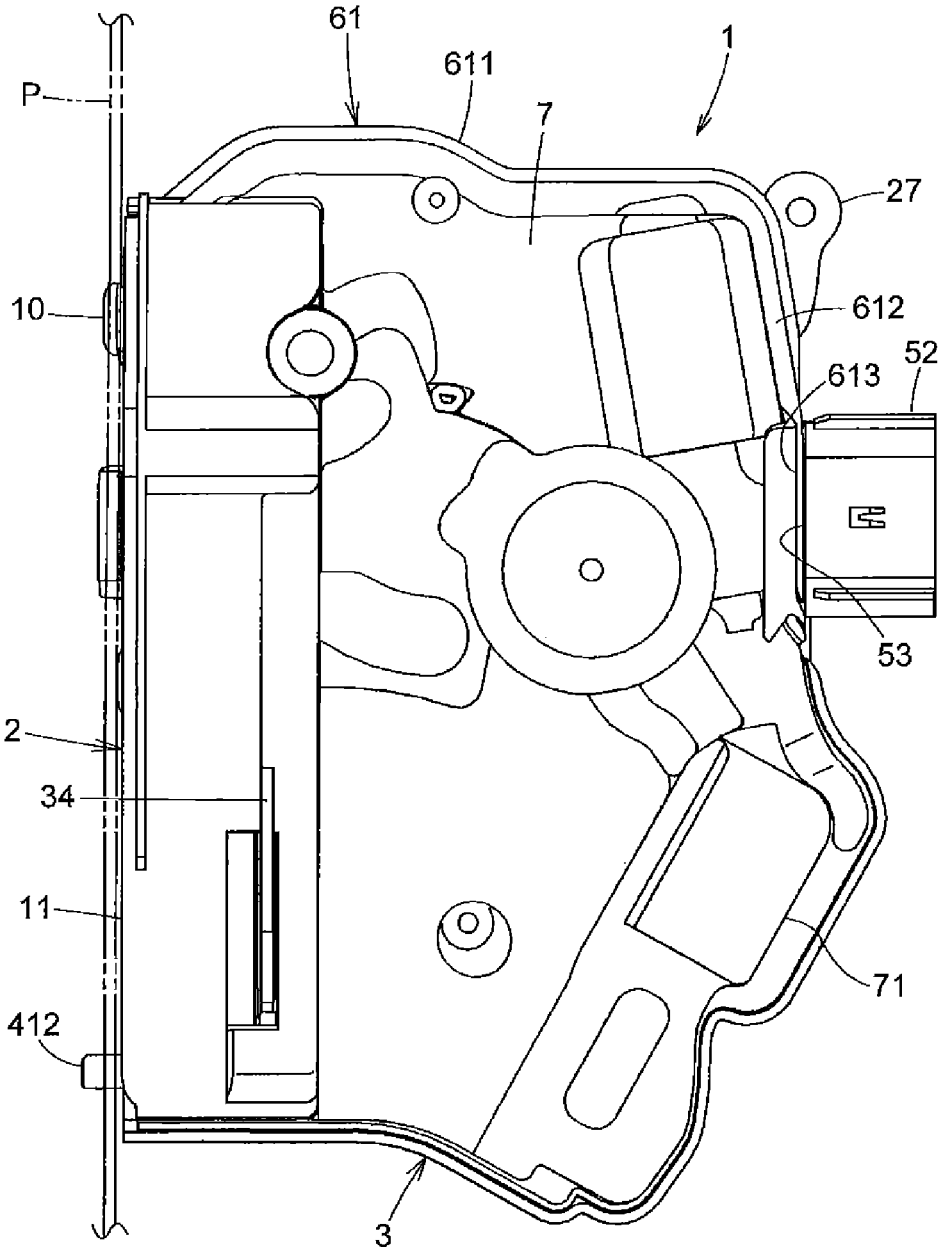
FIG. 2 is a side elevational view showing the door latch device, viewed from a vehicle exterior side.
Figure 7:
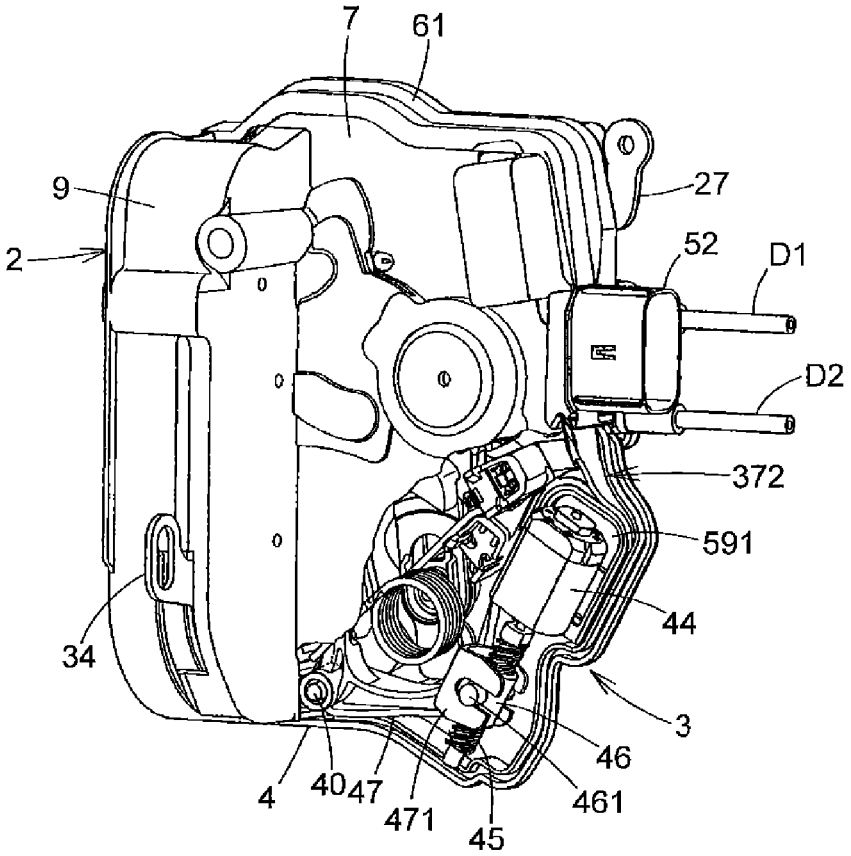
FIG. 7 is a partially cutaway perspective view showing the door latch device, viewed from an obliquely forward direction.
Figure 18:
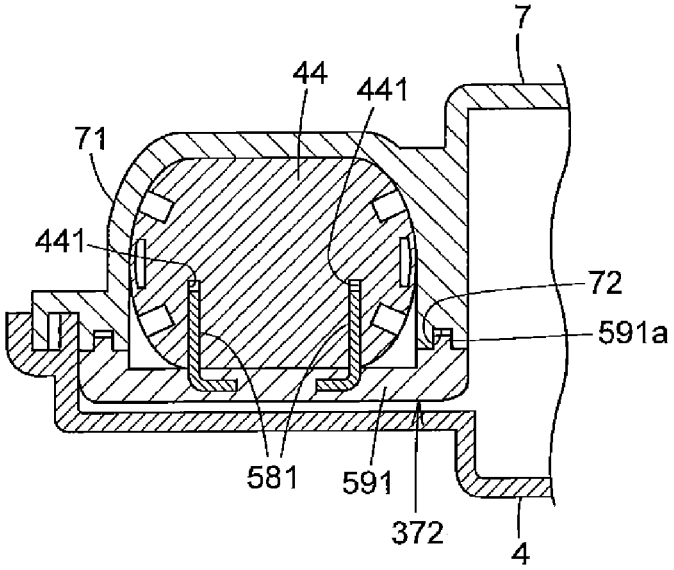
FIG. 18 is an enlarged sectional view taken along the line XVIII-XVIII in FIG. 1.

As shown in FIGS. 2, 7 and 18, a motor housing part 71 which is open inward of the vehicle and in which the double locking motor 44 described below is housed is integrally molded in the inner side of the front lower portion of the above described synthetic-resin casing 7.

The worm wheel 22 bidirectionally rotates from a neutral position against a biasing force of the spring 38 depending on a bidirectional rotation of the locking/unlocking motor 19. When the locking/unlocking motor 19 stops its rotation, the worm wheel 22 automatically returns to the neutral position from a rotated position by the biasing force of the spring 38.

The locking/unlocking lever 24 has teeth 241 engaging with teeth 221 formed at the center portion of the worm wheel 22. When the worm wheel 22 is bidirectionally rotated depending on the rotation of the locking/unlocking motor 19, the locking/unlocking lever 24 is turned between the unlock position in which the door opening operation by the outside handle and inside handle is possible and the lock position in which this operation is impossible.

The knob lever 27 pivots between an unlock position and a lock position depending on an unlock operation and a lock operation of the locking knob. When the locking knob is operated to lock, the knob lever 27 is turned counterclockwise at a predetermined angle from the unlock position shown in FIG. 3 to the lock position. Moreover, the locking/unlocking lever 24 connected to the knob lever 27 and the opening link 28 connected to the locking/unlocking lever 24 are respectively turned between the unlock position in which the door opening operation by the outside handle and inside handle is possible and the lock position in which this operation is impossible.

Figure 3:
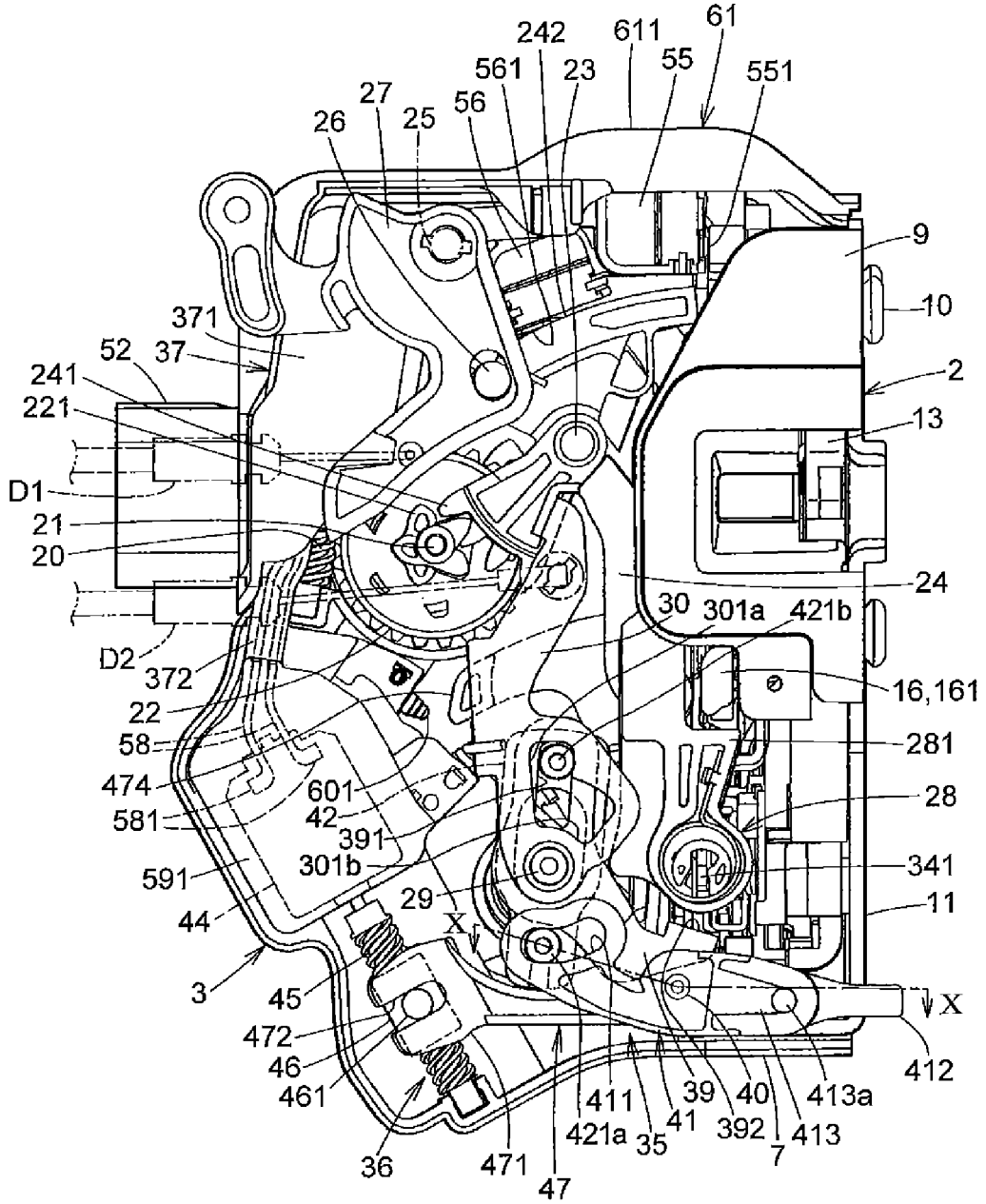
FIG. 3 is a side elevational view showing the door latch device from which a cover is detached, viewed from a vehicle interior side.

The inside lever 30 pivots counterclockwise in FIG. 3 depending on the opening operation of the inside handle. When the locking/unlocking lever 24 is at the unlock position and the childproof locking mechanism 35 is in the childproof unlock state, the inside lever 30 turns the opening lever 16 in the releasing direction via a later described releasing lever 39 connected to the inside lever 30 and the opening link 28, and releases the engagement between the ratchet 15 and the latch 13, thereby opening the door.

A substantially L-shaped fitting hole 301 is formed at the lower portion of the inside lever 30, and an upper connecting shaft 421*b* formed on an upper portion of a connecting lever 42 described below is fit to this fitting hole 301. When the childproof locking mechanism 35 is in the childproof unlock state, the upper connecting shaft 421*b* fits to a vertically long hole 301*a* extending in a vertical direction of an upper portion of the fitting hole 301 so as to move vertically. Therefore, when the door is operated to open, an operation force in a door opening direction of the inside lever 30 is transmitted to a releasing lever 39 described below by the upper connecting shaft 421*b*. When the childproof locking mechanism 35 is in the childproof lock state, the upper connecting shaft 421*b* moves downward to a wide backward hole 301*b* which is continuing from the vertically long hole 301*a* and is extending in a backward direction (opposite direction to the door opening operation direction of the inside lever) in a lower portion of the fitting hole 301. Thus, when the door is operated to open, the inside lever 30 is made to swing idly such that the operation force in the door opening direction of the inside lever 30 is not transmitted to a releasing lever 39 by the upper connecting shaft 421*b* (described below in detail).

The lower portion of the opening link 28 is connected to a connecting end part 341 in the vehicle-interior-side of the outside lever 34 so as to pivot at a predetermined angle in the longitudinal direction of the vehicle, and the upper portion of the opening link 28 is connected to the locking/unlocking lever 24 so as to move in the vertical direction. The opening link 28 pivots counterclockwise at a predetermined angle from the unlock position shown in FIG. 3 to the lock position against a biasing force of a spring (not shown), in the state that it is pivotally supported by the connecting end part 341 of the outside lever 34 in conjunction with the pivoting of the locking/unlocking lever 24. When the opening link 28 is at the unlock position (shown in FIG. 3), an upper face of a releasing part 281 formed at an intermediate portion in the vertical direction of the opening link 28 can come into contact with an under face of the released part 161 of the opening lever 16.

When the door is fully closed, and the locking/unlocking lever 24 and the opening link 28 are at the unlock position, the opening link 28 is moved upward to turn the opening lever 16 in the releasing direction by releasing the outside lever 34 depending on an opening operation of the outside handle. Then, the engagement state between the ratchet 15 pivoting with the opening lever 16 and the latch 13 is released, thereby opening the door.

When the door is fully closed, and the locking/unlocking lever 24 and the opening link 28 are at the lock position, the releasing part 281 swings idly to the released part 161 of the opening lever 16 even if the opening link 28 moves upward by releasing the outside lever 34, and therefore the door cannot be opened.

Figure 9:
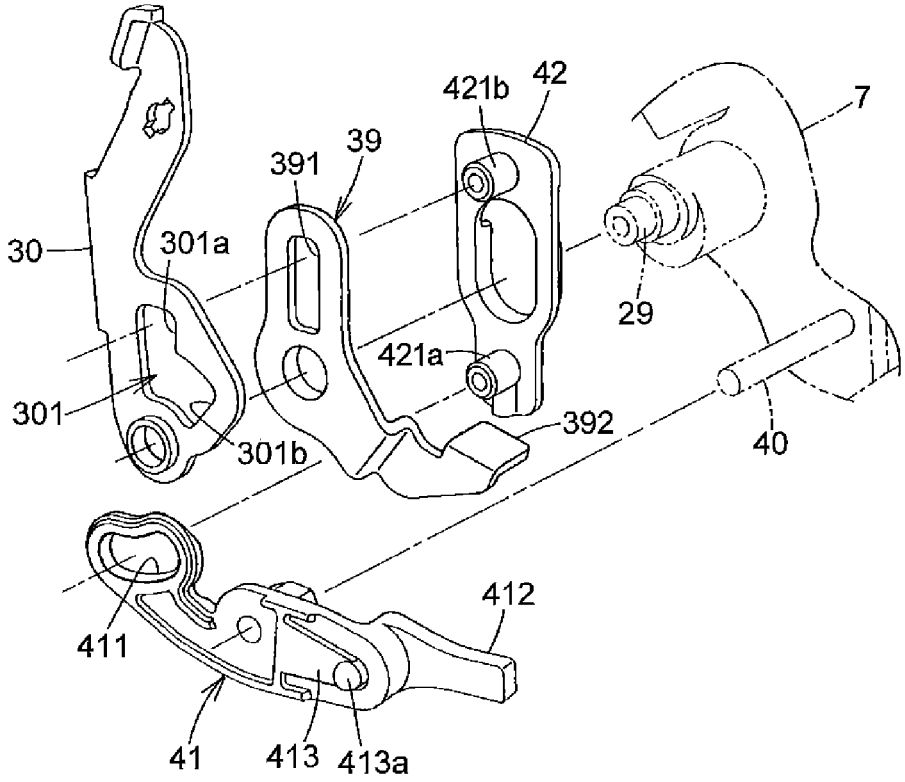
FIG. 9 is an enlarged exploded perspective view showing a childproof locking mechanism.
Figure 10:
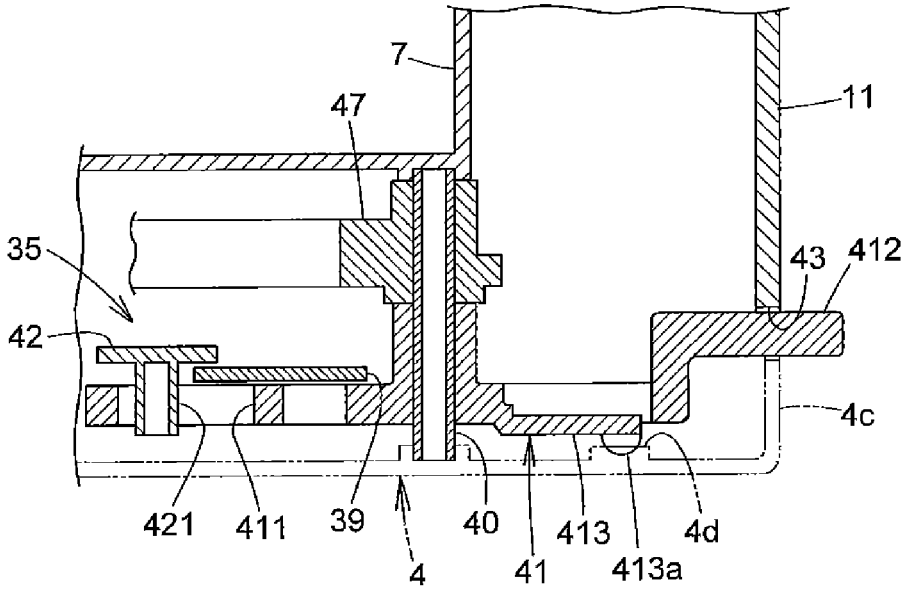
FIG. 10 is an enlarged sectional view taken along the line X-X in FIG. 3.

As shown in FIGS. 9, 10, the childproof locking mechanism 35 comprises the releasing lever 39 of which an intermediate portion is pivotally supported outside the inside lever 30 by the shaft 29 of the inside lever 30, wherein the releasing lever 39 has a long hole 391 extending in the vertical direction and formed in a portion upper than the shaft 29;

a synthetic-resin childproof lever 41 which is housed in a lower end portion rather closer to the rear in the casing 7, and of which an intermediate portion in the longitudinal direction of the vehicle is pivotally supported by a shaft 40 extending in the transverse direction of the vehicle, wherein the childproof lever 41 extends in the longitudinal direction of the vehicle perpendicular to the shaft 40; and a connecting lever 42 extending in the vertical direction which is provided outside the releasing lever 39 so as to move in the vertical direction, wherein a lower connecting shaft 421*a* and an upper connecting shaft 421*b* extending in the inward direction are respectively formed on a lower portion and an upper portion of the connecting lever 42.

An inner side end portion and an outside end portion of the shaft 40 are respectively supported on the inner face of the cover 4 and on the inner face of the casing 7.

A releasing part 392 extending in the outward direction is integrally formed at the rear end portion of the releasing lever 39, which moves the opening link 28 upward (releasing direction) by coming into contact with the lower end of the opening link 28.

The upper connecting shaft 421*b* of the connecting lever 42 passes through the long hole 391 of the releasing lever 39 so as to slide, and engages with the fitting hole 301 of the inside lever 30. The lower connecting shaft 421*a* of the connecting lever 42 engages with an arc-shaped connecting hole 411 long in the longitudinal direction of the vehicle so as to slide, wherein the connecting hole 411 is formed at a front end portion of the childproof lever 41 centered at the shaft 40.

A manual operation part 412 is formed at a rear end portion which is an end portion in the longitudinal direction of the vehicle of the childproof lever 41. This manual operation part 412 projects backward from the rear surface of the cover member 11 of the engagement unit 2. In detail, the manual operation part 412 projects backward from a guide hole 43 extending in the vertical direction, wherein this guide hole 43 is formed between a pair of opposite faces which are a vehicle-interior-side side edge of the cover member 11 of the engagement unit and a vehicle-exterior-side side edge of a bent portion 4*c* formed at a rear portion of the cover 4 so as to be bent to the cover member 11 side. A width dimension (dimension in the transverse direction of the vehicle) of the guide hole 43 is equal to or slightly larger than a thickness of the manual operation part 412 (see FIG. 10) such that side faces in a thickness direction of the manual operation part 412 respectively come close to or slidably contact with the vehicle-interior-side side edge of the cover member 11 and the vehicle-exterior-side side edge of the bent portion 4*c* of the cover 4. According to such a formation, when the childproof lever 41 is turned in the vertical direction by holding the manual operation part 412, the manual operation part 412 is guided by the guide hole 43, thereby preventing the childproof lever 41 from vacillating in the transverse direction of the vehicle. When the door is closed, the manual operation part 412 is covered with a part of the vehicle body, wherein this part is opposite to the rear surface of the door latch device 1. Therefore, the operation of the manual operation part 412 is possible only when the door is open. Although the guide hole 43 is formed between the pair of opposite faces which are the vehicle-interior-side side edge of the cover member 11 and the vehicle-exterior-side side edge of the bent portion 4*c* formed at the rear portion of the cover 4 so as to be bent to the cover member 11 side, the guide hole 43 may be directly formed on the cover member 11 when the bent portion 4*c* of the cover 4 is not formed and alternatively the cover member 11 is enlarged.

An elastic part 413 is formed on a vehicle-interior-side side face rear than the shaft 40 of the childproof lever 41, wherein the elastic part 413 is elastically deformable in the transverse direction of the vehicle centered at a front base portion of the childproof lever 41. A hemispherical projection 413*a* projecting inward of the vehicle is formed on a free end portion (rear end portion) of the elastic part 413. On the other hand, a mound-like projection 4*d* projecting outward is formed on a face of the cover 4 to which the projection 413*a* is opposite, wherein an apical surface of the projection 413*a* can pass over the mound-like projection 4*d* by elastically deforming the elastic part 413 in the outward direction. When the childproof lever 41 is turned from the childproof unlock position (shown in FIG. 3) to the childproof lock position (shown in FIG. 4) or is turned reversely, the projection 413 is moved between an upper side and a lower side while passing over the mound-like projection 4*d*, and therefore the childproof lever 41 is held at the childproof unlock position or the childproof lock position.

When the childproof locking mechanism 35 is in the childproof unlock state, that is, the childproof lever 41 is at the childproof unlock position shown in FIG. 3, as described above, the upper connecting shaft 421*b* of the connecting lever 42 is fit to the vertically long hole 301*a* of the fitting hole 301 of the inside lever 30 while passing through the long hole 391 of the releasing lever 39. Therefore, when the inside lever 30 is operated in the door opening direction (counterclockwise in FIG. 3) by the inside handle (not shown), the operation force is transmitted to the releasing lever 39 by the upper connecting shaft 421*b*, and the releasing lever 39 is turned counterclockwise in conjunction with the inside lever 30. Thus, when the locking/unlocking lever 24 is at the unlock position shown in FIG. 3, the releasing part 392 of the releasing lever 39 comes into contact with the lower end of the opening link 28 to push up the opening link 28, and turns the opening lever 16 in the releasing direction to release the engagement between the latch 13 and the ratchet 15, thereby opening the door.

Figure 4:
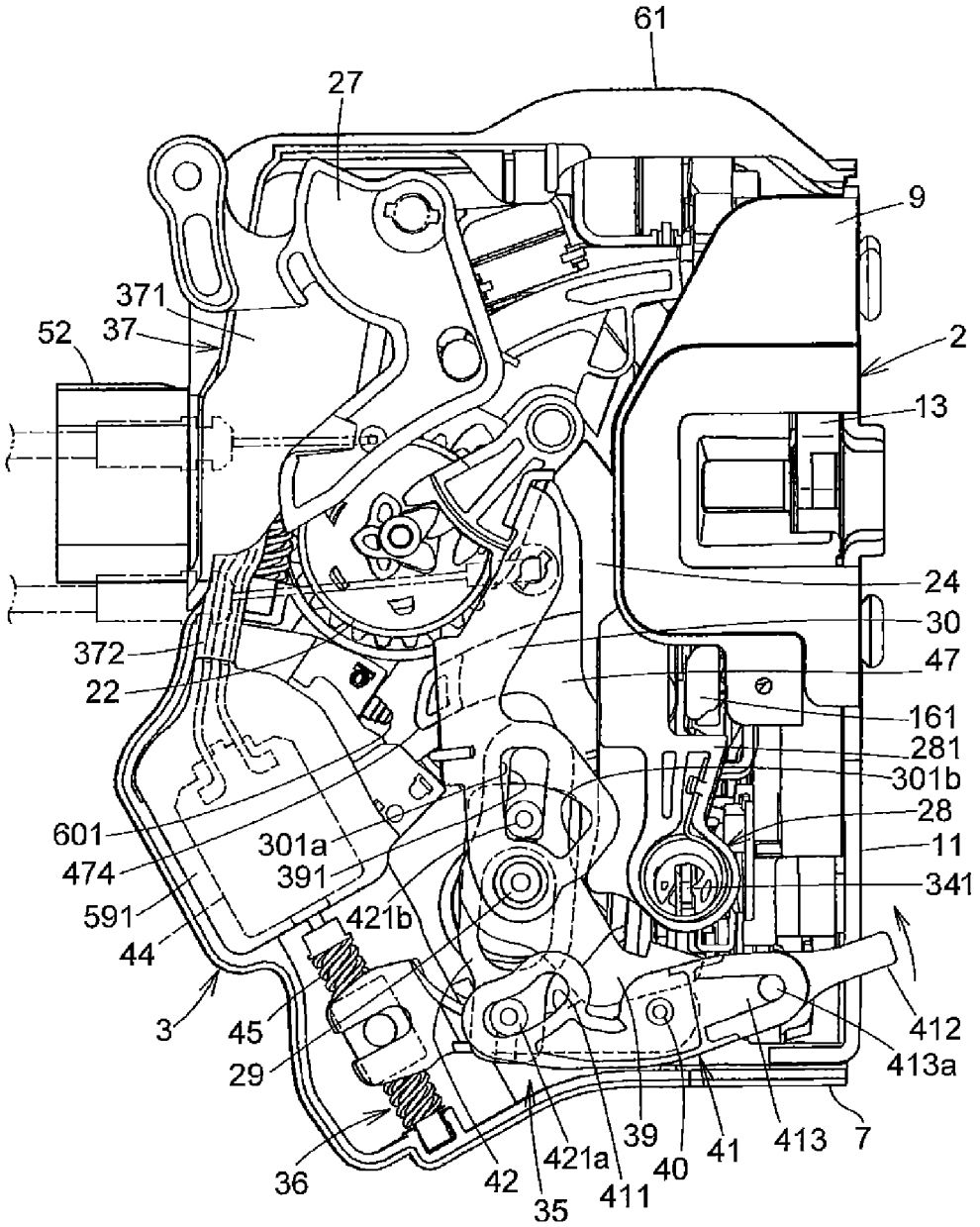
FIG. 4 is a side elevational view showing the door latch device of which a childproof lever is moved to a lock position, viewed from a vehicle interior side.

On the other hand, when the childproof locking mechanism 35 is in the childproof lock state, that is, the manual operation part 412 of the childproof lever 41 is pushed up to turn the childproof lever 41 to the childproof lock position (counterclockwise) as shown in FIG. 4, the connecting lever 42 is moved downward by the lower connecting shaft 421*a* fit to the connecting hole 411 of the childproof lever 41. Then, the upper connecting shaft 421*b* moves downward to the backward hole 301*b* of the fitting hole 301 of the inside lever 30. Therefore, even if the locking knob (not shown) in the door is unlocked to make the locking/unlocking lever 24 be in the unlock state and the inside lever 30 is turned in the door opening direction, the inside lever 30 swings idly, and thus the operation force of the inside lever 30 is not transmitted to the releasing lever 39 by the upper connecting shaft 421*b*. Accordingly, because the opening lever 16 cannot be turned in the releasing direction via the releasing lever 39 and the opening link 28 in the childproof lock state, the door cannot be opened by operating the inside lever 30. Even if the childproof locking mechanism 35 is in the childproof lock state, as far as the locking/unlocking lever 24 is in the unlock state, when the outside handle of the door is operated to turn the outside lever 34 in the door opening direction, the opening lever 16 can be turned in the releasing direction by the opening link 28, thereby opening the door from the vehicle exterior side.

Figure 5:
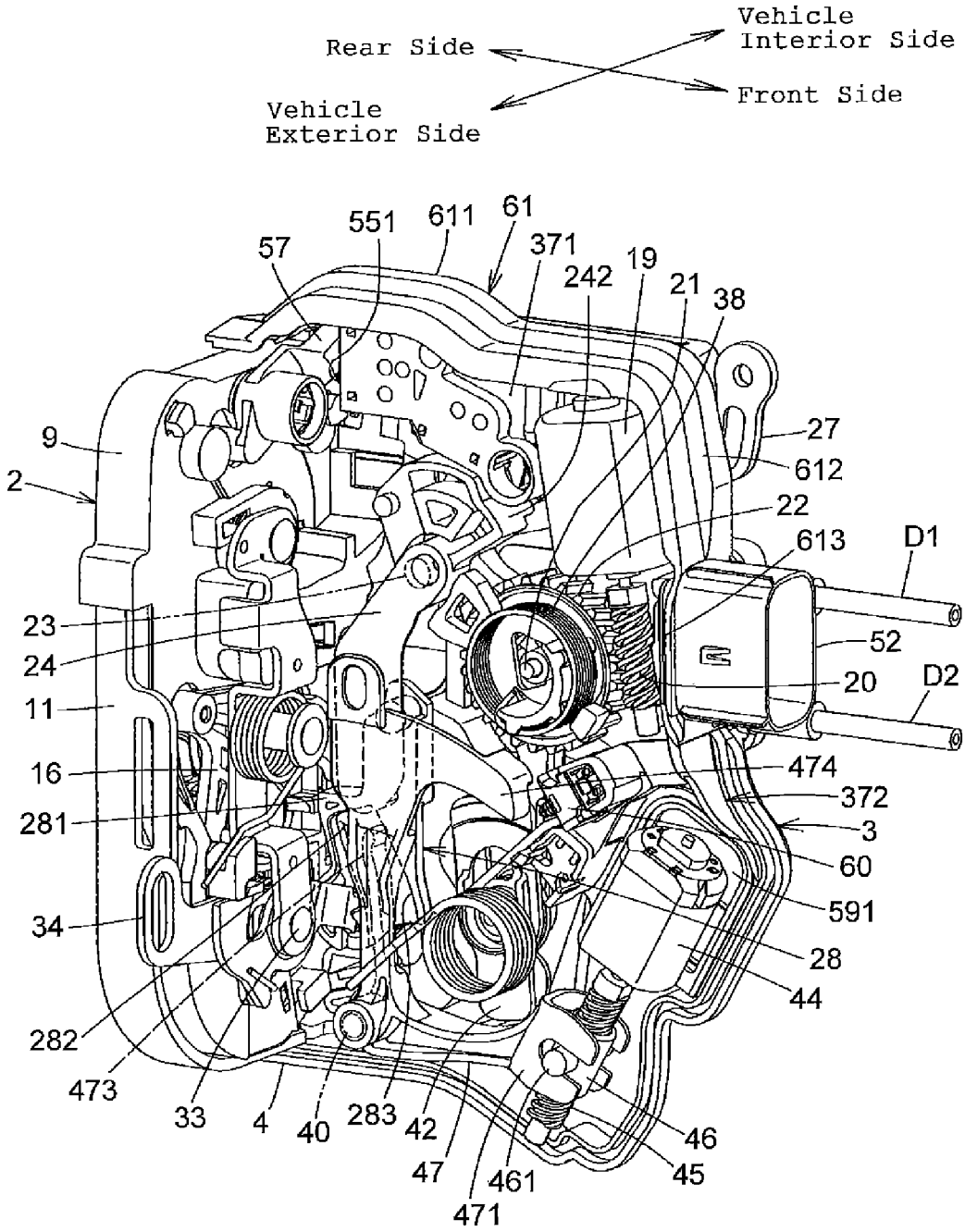
FIG. 5 is a perspective view showing the door latch device from which a casing is detached, viewed from an obliquely forward direction.

As shown in FIGS. 3, 5; in downward than the motion transmission members D1, D2 and a later described female connector 52 of the switch member 37; the double locking mechanism 36 comprises the double locking motor 44 rotatable bidirectionally being housed in the motor housing part 71 which is open inward of the vehicle in the casing 7 such that its rotation axis is tilted, a helical gear 45 tilted in an oblique rear lower direction to be rotated by the double locking motor 44, a cylindrical moving member 46 screwed to the helical gear 45 to move in an axis direction by rotation of the helical gear 45, and a double locking lever 47 of which a rear lower end portion is pivotally supported by the shaft 40 (see FIG. 10) of the above described childproof lever 41 and of which a front end portion substantially U-shaped in a side face view is connected to the moving member 46.

The double locking lever 47 is provided outside the opening link 28 such that a part of a vertical directed portion of the double locking lever 47 overlaps with a part of the vehicle-exterior-side side face of the opening link 28. A two-forked connecting part 471 holding the moving member 46 from backward is formed on a front end portion of the double locking lever 47. U-shaped notched grooves 472 formed in this connecting part 471 are fit from backward to a pair of driving pins which are formed on the moving member 46 so as to project in the transverse direction of the vehicle, thereby connecting the double locking lever 47 to the moving member 46.

In the state that the door is locked, when the double locking motor 44 is actuated by a portable remote control switch, etc., the moving member 46 is moved downward according to the rotation of the double locking motor 44. Thus, the double locking lever 47 pivots around the shaft 40 counterclockwise at a predetermined angle from a double unlock position shown in FIGS. 3, 5 to a double lock position (counterclockwise in FIG. 3, clockwise in FIG. 5).

When the double locking lever 47 pivots to the double lock position, a vertical direction block rib 473 (see FIG. 5) formed at a part of the double locking lever 47 to which the opening link 28 is opposite comes near to and faces a block wall part 283 in a concavity 282, wherein the concavity 282 is formed on the vehicle-exterior-side side face of the opening link 28 turned to the lock position with the locking/unlocking lever 24, and wherein the block wall part 283 is a front side wall of the concavity 282, thus a double lock state is formed. When the double locking lever 47 pivots to the double lock position, a tip portion of a forward extending portion 474 formed on an upper end portion of the double locking lever 47 comes into contact with a switch pin 601 of a double locking detection switch 60 fixed to a second switch member 372 described below to press the switch pin 601. Then, a double locking signal is sent to a control circuit device, etc., and the rotation of the double locking motor 44 is stopped.

In the state of the double lock, when the locking knob in a vehicle is operated to unlock, the locking/unlocking lever 24 connected to the knob lever 27 and the opening link 28 connected to the locking/unlocking lever 24 are about to be turned from the lock position to the unlock position (shown in FIG. 3). However, because the block wall part 283 of the opening link 28 comes into contact with the block rib 473 of the double locking lever 47 which is at rest at the double lock position, the opening link 28 and the locking/unlocking lever 24 are prevented from turning to the unlock position. Therefore, when it is in the double lock state, the door opening operation by the outside handle of the door is originally blocked, and the shift from the lock state to the unlock state is blocked.

As shown in FIGS. 11-17, the above described switch member 37 comprises a first switch member 371 electrically conductive to the locking/unlocking motor 19, etc. and the second switch member 372 electrically conductive to the double locking motor 44, etc. This member 37 is formed by coupling the second switch member 372 to the first switch member 371.

Figure 11:
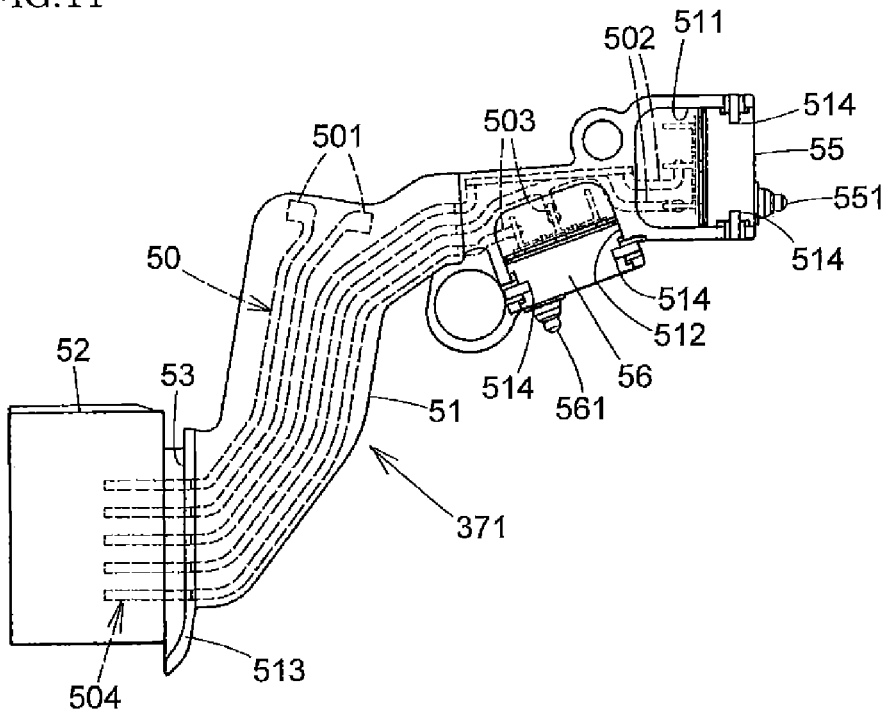
FIG. 11 is a side view showing a first switch member, viewed from a vehicle interior side.

As shown in FIG. 11, the first switch member 371 has a shape which can be housed in the upper and front upper portions of the casing 7. This member 371 comprises a plurality of (five) conductive members 50 electrically conductive to the locking/unlocking motor 19, a door opening/closing detection switch 55 described below and a locking/unlocking detection switch 56 described below;

an insert molded resin member 51 shielding the conductive members 50; and a synthetic-resin female connector 52 which is integrally molded with a front edge face of the resin member 51 so as to project from the casing 7 and is open frontward.

Connection terminals 501 of the respective conductive members 50 for the locking/unlocking motor 19 are exposed from a vehicle-exterior-side side face of the resin member 51 for the purpose of connecting to the locking/unlocking motor 19 housed in the casing 7. Moreover, connection terminals 502 of the respective conductive members 50 for the door opening/closing detection switch 55 and connection terminals 503 of the respective conductive members 50 for the locking/unlocking detection switch 56 are respectively exposed in switch housing parts 511, 512 which are respectively formed on a vehicle-interior-side side face of a rear end portion of the resin member 51 for the purpose of housing the door opening/closing detection switch 55 and the locking/unlocking detection switch 56. The connection terminals 502, 503 are respectively connected to the door opening/closing detection switch 55 and the locking/unlocking detection switch 56 in each switch housing part 511, 512. Furthermore, pin-shaped connection terminals 504 of the respective conductive members 50 connected to an external male connector respectively project in the female connector 52 so as to follow in a direction (forward) along which the external male connector is connected. A bent portion 513 bent in a thickness direction of the resin member 51, that is, in the outward direction at substantially right angles is on the front end portion of the resin member 51. The female connector 52 is integrally molded with the front face of this bent portion 513. A gap 53 is formed between a pair of opposite faces of the female connector 52 and the bent portion 513, wherein a front lower portion of a top waterproof cover 61 described below is fit to this gap 53 from above.

Figure 12:
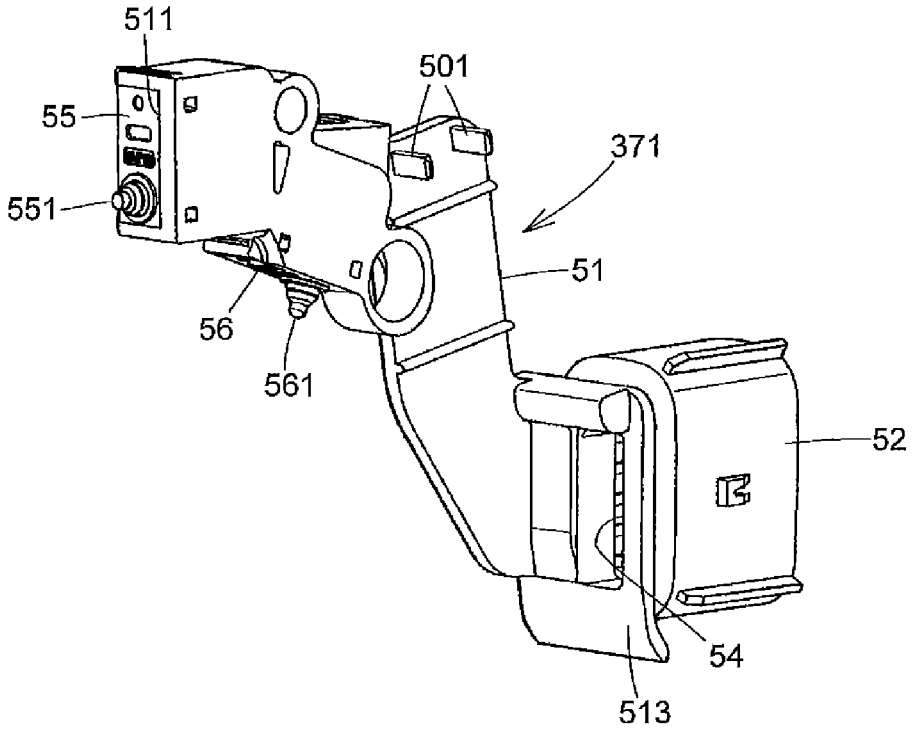
FIG. 12 is a perspective view showing the first switch member, viewed from a vehicle exterior side.
Figure 15:
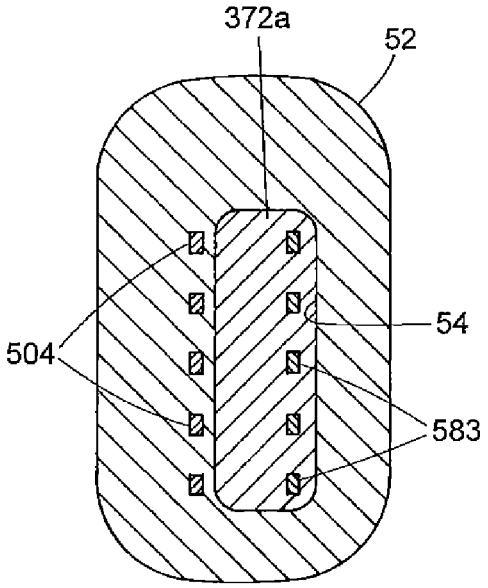
FIG. 15 is an enlarged sectional view taken along the line XV-XV in FIG. 14.
Figure 16:
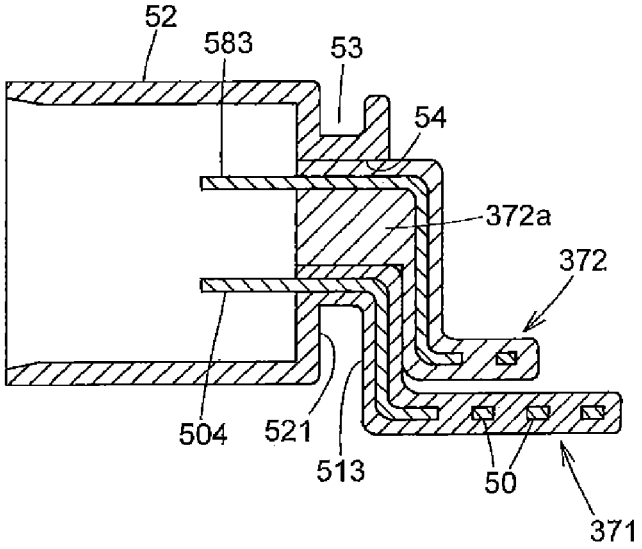
FIG. 16 is an enlarged sectional view taken along the line XVI-XVI in FIG. 14.

As shown in FIGS. 12, 15, 16, a substantially rectangular connecting hole 54 extending vertically is formed on the bent portion 513 and a wall part 521 of a base end portion of the female connector 52 such that this hole 54 longitudinally passes through the bent portion 513 and a part where the connection terminals 504 are not inserted on the wall part 521, wherein a connecting part 372*a* of an upper portion of the second switch member 372 is fit to this hole 54 from backward. The connection terminals 504 of the respective conductive members 50 project into the female connector 52 at a part which is close to the connecting hole 54 and is in the vehicle interior side of the connecting hole 54 (left side in FIG. 15, lower side in FIG. 16).

As shown in FIG. 11, the switch housing parts 511, 512 are formed on a rear portion of the resin member 51 of the first switch member 371, and the door opening/closing detection switch 55 for detecting a half-latch state of the door is housed in the switch housing part 511 without loosening while a retractable switch pin 551 is oriented backward. The locking/unlocking detection switch 56 for detecting the lock/unlock states of the door is housed in the switch housing part 512 without loosening while a retractable switch pin 561 is extending in an oblique rear lower direction. Each of the door opening/closing detection switch 55 and the locking/unlocking detection switch 56 is held by a pair of elastic holding parts 514, 514, wherein each pair of elastic holding parts is provided in the switch housing parts 511, 512 and has inward facing engaging claws on their tip end portions.

As shown in FIG. 5, the switch pin 551 of the door opening/closing detection switch 55 is pressed by a detection lever 57 which is pivotally supported on the body 9 of the engagement unit 2 and is turned by contacting with an outer peripheral surface of the latch 13. That is, the door opening/closing detection switch 55 is in an off state when the latch 13 pivots to a full-latch position (full close position of door), and is in an on state to inform that the door is in half open or open state by lighting a room lamp, etc. of a vehicle when the latch 13 pivots to a half-latch position (half open position of door) and an open position respectively. Although it is not shown, it may be possible that a depth dimension of the switch housing part 511 of the first switch member 371 is increased such that two door opening/closing detection switches 55 are housed, and that when any one of the door opening/closing detection switches 55 cannot be operated due to a trouble, etc., the other door opening/closing detection switch 55 is operated to light a room lamp, etc.

The switch pin 561 of the locking/unlocking detection switch 56 comes in contact with a cam face 242 formed on an upper face of the locking/unlocking lever 24 (see FIGS. 3, 5). When the locking/unlocking lever 24 is shifted between the unlock position (shown in FIG. 3) and the lock position (clockwise in FIG. 3) by the locking/unlocking motor 19 or the knob lever 27, an on/off signal is transmitted to a control circuit, etc. by the locking/unlocking detection switch 56, and then a lock/unlock state of the door is detected. Moreover, when the locking/unlocking lever 24 is shifted to the unlock position or the lock position by the locking/unlocking motor 19, the locking/unlocking motor 19 is automatically stopped at the same time of the activation of the locking/unlocking detection switch 56.

Figure 13:
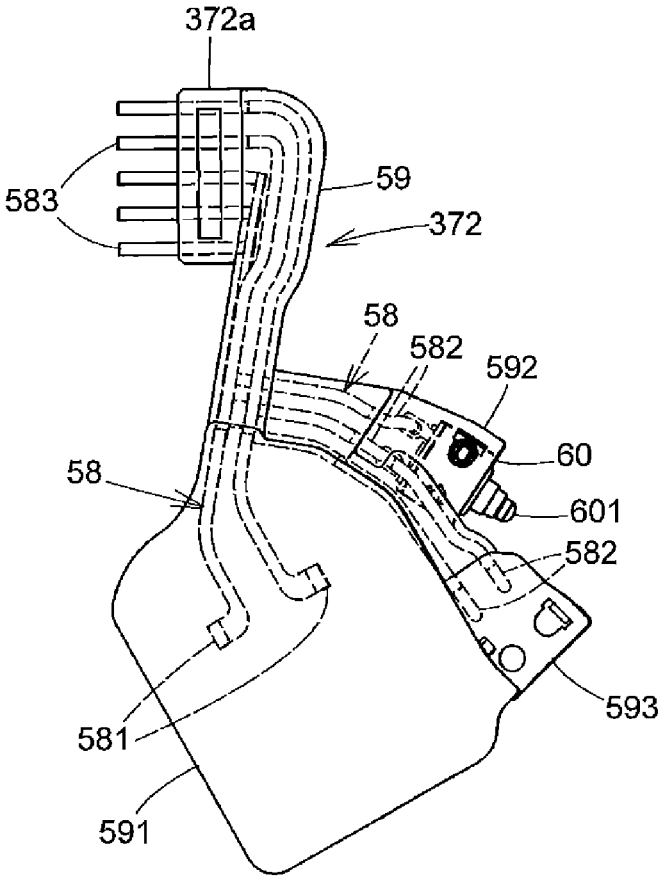
FIG. 13 is a side view showing a second switch member, viewed from a vehicle interior side.

As shown in FIG. 13, the second switch member 372 comprises a plurality of (five) conductive members 58, and an insert molded resin member 59 shielding these members 58. Five conductive members 58 are provided to be electrically conductive to the double locking motor 44 and the double locking detection switch 60, and also to be electrically conductive to a childproof locking detection switch (not shown) when the second switch member 372 is shared with another actuator unit comprising a power childproof locking mechanism.

A wide motor cover 591 is integrally molded with a lower portion of the resin member 59, wherein this cover 591 is has a size for covering the double locking motor 44 from the vehicle interior side and sealing an inner side opening of the motor housing part 71 of the casing 7. The connection terminals 581 of the respective conductive members 58 for the double locking motor 44 project from an upper side of the vehicle-exterior-side side face of the motor cover 591 (see FIG. 17). Switch housing parts 592, 593 are integrally molded with an upper portion of the motor cover 591, wherein this portion 592 is open outward for housing the double locking detection switch 60, and wherein this portion 593 houses a childproof locking detection switch when the second switch member 372 is shared with an actuator unit comprising a power childproof mechanism.

Each of the switch housing parts 592, 593 has a pair of elastic holding parts 592*a*, 593*a* for holding the double locking detection switch 60 and the childproof locking detection switch respectively, wherein these pairs of elastic holding parts 592*a*, 593*a* are the same as those provided in the first switch member 371. Connection terminals 582 of some of the conductive members 58 for the double locking detection switch 60 and connection terminals 582 of the other conductive members 58 for the childproof locking detection switch (not shown) are exposed in respective switch housing parts 592, 593.

The connecting part 372*a* is molded in a frontward direction integrally with a front upper portion of the resin member 59 of the second switch member 372, wherein the connecting part 372*a* is fit to the connecting hole 54 formed in the female connector 52 of the first switch member 371 from backward. A plurality of pin-shaped connection terminals 583 of the respective conductive members 58 project frontward from a portion close to the outer side of the connecting part 372*a*, wherein these connection terminals 583 are connected to an external control circuit device, etc. The connecting part 372*a* has a complementary cross-sectional shape with the connecting hole 54 of the female connector 52. Hence, when the connecting part 372*a* is fit to the connecting hole 54, an outer peripheral surface of the connecting part 372*a* comes into surface contact with an inner circumferential surface of the connecting hole 54, and the connecting part 372*a* is prevented from coming out from the connecting hole 54 because of their contact frictional force (see FIGS. 15, 16).

Figure 14:
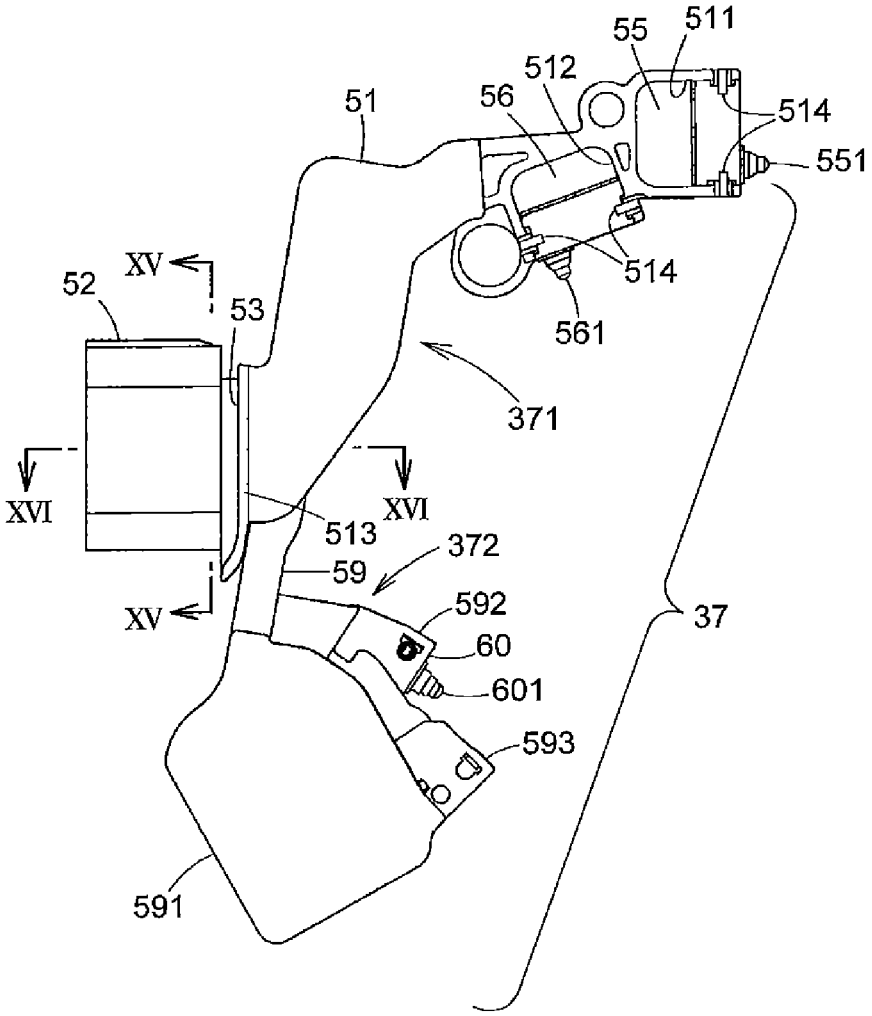
FIG. 14 is a side view showing a switch member formed by coupling the first and second switch members, viewed from a vehicle interior side.

The connecting part 372*a* of the second switch member 372 is removably fit to the connecting hole 54 of the first switch member 371 in a direction opposite to the female connector 52 (from backward of the female connector 52) to connect the second switch member 372 to the first switch member 371, and thereby forming the switch member 37 (see FIG. 14).

When the second switch member 372 is coupled with the first switch member 371, the connection terminals 583 of the second switch member 372 project in the female connector 52 so as to follow the same direction as the connection terminals 504 of the first switch member 371 (connection direction for an external male connector). Hence, when a wire harness male connector connected to an external control circuit device, etc. is inserted to the female connector 52, it is possible to be electrically conductive to both the first switch member 371 and the second switch member 372 with the single female connector 52.

Figure 17:
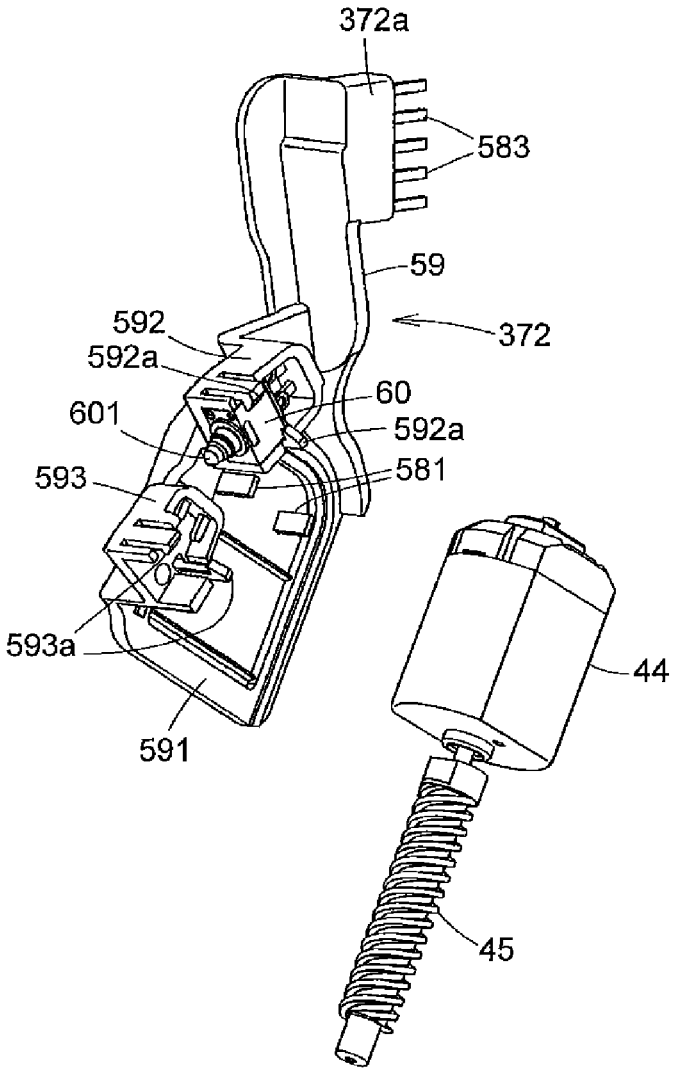
FIG. 17 is a perspective view showing the second switch member in a state before attaching a double locking motor.

As shown in FIGS. 5, 17, 18, an assembly sequence of an installation of the switch member 37 and the double locking motor 44 comprises the steps of fitting the double locking motor 44 on the motor cover 591 of the second switch member 372, fitting the switch member 37 together with the double locking motor 44 on the casing 7, and screwing the cover 4 to the casing 7 to shield the inner side opening of the casing 7 with the cover 4. Thus, the inner side opening of the motor housing part 71 of the casing 7 is shielded by the motor cover 591. In this occasion, an elongated projection 591*a* formed on an outside peripheral portion of the motor cover 591 is fit in a groove 72 formed on an opening face of the motor housing part 71 (see FIG. 18), thereby preventing rainwater from getting into the motor housing part 71.

Next, the connection region 4*a* formed on the cover 4 is covered with the auxiliary cover 5. Thus, as shown in FIG. 18, the motor cover 591 of the second switch member 372 and the helical gear 45 and the vicinity thereof are covered from the vehicle interior side with the cover 4, and the terminal insertion parts 441 side of the double locking motor 44 are covered from the vehicle interior side with the motor cover 591 of the second switch member 372. The terminal insertion parts 441 are connection parts of the double locking motor 44 with the switch member 37, into which the connection terminals 581 of the second switch member 372 are inserted. Because the whole double locking motor 44 including the terminal insertion parts 441 is shielded by the motor housing part 71 of the casing 7 and the motor cover 591 of the second switch member 372, it is possible to increase a waterproof property for the whole double locking motor 44 including the terminal insertion parts 441. Furthermore, because a vehicle-interior-side side face of the motor cover 591 of the second switch member 372 is covered with the cover 4, the waterproof property for the double locking motor 44 is more increased.

Therefore, because there is no risk that rainwater, etc. which has entered from through holes for the motion transmission members D1, D2 of the casing 7 infiltrates into the terminal insertion parts 441, etc. of the double locking motor 44, it is possible to arrange the double locking motor 44 below the motion transmission members D1, D2, and it is possible to increase flexibility of design and layout of respective components such as the childproof locking mechanism 35, the double locking mechanism 36, etc. The above assembly sequence of the installation of the double locking motor 44 may be carried out reversely: that is, the cover 4, the switch member 37, fitting of the double locking motor 44 to the motor cover 591, and the casing 7 in this order.

As shown in FIGS. 2, 6, the synthetic-resin top waterproof cover 61 is fit on an upper portion of a connection part of the cover 4 and the casing 7, thereby preventing rainwater which has entered into the door from getting into the casing 7 from the upper portion of the connection part. The top waterproof cover 61 has an upper covering part 611 covering the upper portion of the connection part of the cover 4 and the casing 7 so as to interpose the upper portion, and a front side covering part 612 covering the front upper portion of the connection part of the cover 4 and the casing 7 so as to interpose the front upper portion. A two-forked insertion part 613 extending downward is formed at a lower end of the front side covering part 612. Moreover, protrusive parts 614, 614 extending inward are formed on a vehicle-interior-side side face of the upper covering part 611 so as to be apart from each other in the longitudinal direction of the vehicle.

When the top waterproof cover 61 is fit on the upper portion of the cover 4 and the casing 7, the insertion part 613 is inserted from above into a peripheral portion of the gap 53 formed between the female connector 52 and the bent portion 513 of the first switch member 371. Thus, a motion of the top waterproof cover 61 in the longitudinal direction of the vehicle is restricted. Moreover, when the auxiliary cover 5 is attached, an underface of an oriented outward bent portion 5*a* formed at an upper portion of the auxiliary cover 5 comes into contact with an upper face of the front protrusive part 614, thereby preventing the top waterproof cover 61 from being off upward (see FIG. 1).

As described above, in the door latch device of the above embodiment, the motor cover 591 covering the double locking motor 44 from the vehicle interior side is provided to the second switch member 372, the double locking motor 44 is housed in the motor housing part 71 integrally molded with the casing 7, the opening of this motor housing part 71 is shielded by the motor cover 591, and therefore it is possible to increase the waterproof property for the double locking motor 44 and the terminal insertion parts 441. Accordingly, there is no risk that rainwater which has entered into the casing 7 infiltrates into the motor housing part 71 and attaches to the terminal insertion parts 441 of the motor 44.

The foregoing relates to the embodiments of the present invention, but the following various changes and modifications may be added to the present embodiments without departing from the gist of the present invention.

In the above embodiment, although the door latch device comprises the double locking mechanism 36, and the terminal insertion parts 441 of the double locking motor 44 of this double locking mechanism 36 is covered with the motor cover 591 provided to the second switch member 372 from the vehicle interior side, it also may be possible that the present invention is applied to a door latch device comprising a childproof locking motor which can automatically shift a childproof locking mechanism provided in the casing 7 between a childproof lock state and a childproof unlock state, and that the childproof locking motor and its terminal insertion parts are covered with the motor cover 591 provided to the second switch member 372 which is the same as the above from the vehicle interior side.

Moreover, it also may be possible that a wide motor cover for covering the vehicle-interior-side side face of the locking/unlocking motor 19 is provided to the resin member 51 of the first switch member 371.

What is claimed is:

1. A door latch device fixed to a vehicle door comprising a casing having an opening which is open inward of a vehicle when the door is closed, a motor housed in the opening of the casing for controlling an operation mechanism which shifts the door between a lock state and an unlock state, and a switch member housed in the opening of the casing and comprising a conductive member electrically conductive to the motor, wherein the switch member has a motor cover in a size for covering the motor from a direction facing the opening of the casing, wherein a connection part of the motor is connected to the conductive member on a side face facing the motor of the motor cover, and the motor and the connection part are covered with the motor cover from the direction facing the opening of the casing, wherein the motor is housed in the casing below a connector of the switch member and a motion transmission member, the connector of the switch member being connected to an external connector, and the motion transmission member being connected with an operation lever which is a part of the operation mechanism, wherein the operation lever comprises a knob lever that pivots between an unlock position and a lock position depending on an unlock operation and a lock operation of a locking knob for manual operation, and an inside lever that pivots depending on an opening operation of an inside handle for door opening operation, and wherein the motion transmission member comprises a first motion transmission member connecting the locking knob with the knob lever and a second motion transmission member connecting the inside handle with the inside lever.

2. The door latch device according to claim 1, wherein a motor housing part which is open inward of the vehicle when the door is closed is formed on the casing, and an opening of the motor housing part is shielded by the motor cover in a state that the motor is housed in the motor housing part.

3. The door latch device according to claim 2, wherein an opposite side face to the side face facing the motor of the motor cover is covered with a cover fixed to the casing.

4. The door latch device according to claim 2, wherein the motor is a double locking motor for controlling a locking/unlocking lever which is a part of the operation mechanism to be in a double lock state, or is a childproof locking motor for shifting a childproof locking mechanism between a childproof lock state and a childproof unlock state.

5. The door latch device according to claim 3, wherein the motor is a double locking motor for controlling a locking/unlocking lever which is a part of the operation mechanism to be in a double lock state, or is a childproof locking motor for shifting a childproof locking mechanism between a childproof lock state and a childproof unlock state.

6. The door latch device according to claim 1, wherein the motor is a double locking motor for controlling a locking/unlocking lever which is a part of the operation mechanism to be in a double lock state, or is a childproof locking motor for shifting a childproof locking mechanism between a childproof lock state and a childproof unlock state.

7. The door latch device according to claim 1, further comprising a cover for covering the opening of the casing, wherein the cover is provided with a connection region in which the first and second motion transmission members are respectively connected with the knob lever and the inside lever, the connection region being formed on a surface of the cover opposite to the opening of the casing so as to be positioned above the motor and be recessed toward the opening of the casing, wherein the knob lever is pivotally supported in the connection region by a shaft formed in the connection region and is connected with the first motion transmission member in the connection region, wherein the inside lever is housed in the opening of the casing and is covered with the cover, an upper end portion of the inside lever projecting to the connection region through a notch that is formed in the connection region so as to communicate between the opening of the casing and the connection region, and the second motion transmission member being connected with the upper end portion of the inside lever, and wherein the connection region is shielded by an auxiliary cover facing the connection region.

8. The door latch device according to claim 7, wherein a horizontal direction position of the notch of the connection region is different from that of the motor.

* * * * *